US006864622B2

(12) United States Patent
Matsutani et al.

(10) Patent No.: US 6,864,622 B2
(45) Date of Patent: Mar. 8, 2005

(54) SPARK PLUG

(75) Inventors: Wataru Matsutani, Nagoya (JP); Masayuki Segawa, Nagoya (JP); Satoko Ito, Nagoya (JP); Osamu Yoshimoto, Kakamigahara (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 242 days.

(21) Appl. No.: 10/297,201

(22) PCT Filed: Mar. 27, 2002

(86) PCT No.: PCT/JP02/03008

§ 371 (c)(1),
(2), (4) Date: Dec. 4, 2002

(87) PCT Pub. No.: WO02/080321

PCT Pub. Date: Oct. 10, 2002

(65) Prior Publication Data

US 2004/0027042 A1 Feb. 12, 2004

(30) Foreign Application Priority Data

Mar. 28, 2001 (JP) ..... 2001-091585

(51) Int. Cl.[7] ..... H01T 13/20
(52) U.S. Cl. ..... 313/141
(58) Field of Search ..... 313/141

(56) References Cited

FOREIGN PATENT DOCUMENTS

| | | |
|---|---|---|
| JP | 9-7733 | 1/1997 |
| JP | 9-219274 | 8/1997 |
| JP | 10-321342 | 12/1998 |
| JP | 11-97151 | 4/1999 |
| JP | 11-97152 | 4/1999 |
| JP | 2001-185323 | 7/2001 |

*Primary Examiner*—Vip Patel
(74) *Attorney, Agent, or Firm*—Morgan, Lewis & Bockius LLP

(57) ABSTRACT

The object of the present invention is to provide a spark plug having a discharge portion formed of a noble-metal chip increased in the Ir content while reducing the content of expensive Rh, which can be restrained from generation of unusual wear in the form of eroding the circumferential side surface of the noble-metal chip and exhibits excellent wear resistance.

In the present invention, the discharge portion (31) in the center electrode (3) side is formed of a noble-metal chip (31') comprising an Ir-based alloy and the noble-metal chip (31') contains 90% by weight or more of Ir as the main component and further contains 0.5% by weight or more of Rh and from 0.5 to 8% by weight of Ni, whereby the noble-metal chip (31') [discharge portion (31)] can be ensured with good wear resistance, the generation of unusual wear which readily occurs on decreasing the Rh content can be prevented by the addition of Ni and in turn, a spark plug having high performance can be fabricated at a low cost.

4 Claims, 4 Drawing Sheets

SPARK PLUG

TECHNICAL FIELD

The present invention relates to a spark plug used for ignition in an internal combustion engine, such as an automobile engine.

BACKGROUND ART

A spark plug used for ignition in an internal combustion engine, such as an automobile engine, is affected by a tendency of increasing combustion chamber temperature for the purpose of increasing engine output and improving fuel economy. In order to enhance ignition, in an increasing number of engines the discharge portion facing to a spark discharge gap of a spark plug projects into a combustion chamber. In such applications, a discharge portion of the spark plug is exposed to high temperature, and thus spark-effected wear of the discharge portion tends to accelerate. In order to enhance spark-effected wear resistance of a discharge portion facing to a spark discharge gap, there have been proposed many spark plugs of the type in which a noble-metal chip containing a predominant amount of Pt, Ir, or a like element is welded to the tip of an electrode.

For example, Japanese Patent Application Laid-Open (kokai) No. 9-7733 discloses a spark plug in which a noble-metal chip contains an alloy of Ir and Rh so as to utilize the merit of Ir; i.e., high melting point, and simultaneously prevent oxidational volatilization of Ir at high temperature (about 900° C. or higher), thereby enhancing wear resistance (spark resistance and high temperature oxidization are hereinafter referred to as "wear resistance" in the present specification) at higher temperature.

However, Rh is expensive several times as compared with Ir and moreover, the melting point of Rh is 1,970° C. and low in comparison with 2,454° C. of Ir. Therefore, if the Rh content is excessively increased, there arises a problem that not only the material cost of the noble-metal chip elevates highly but also the resistance against spark wear becomes insufficient.

To solve this problem, the present inventors have attempted to improve the spark wear resistance while restraining the wear due to oxidational volatilization by reducing the Rh content. However, it has been found that if the Rh content is reduced as such, rather the wear in the discharge portion (noble-metal chip) cannot be restrained in some cases due to generation of unusual wear which is described later.

More specifically, the present inventors conducted the following experiment. A 6-cylinder gasoline engine (piston displacement: 2,000 cc) was equipped with a spark plug configured such that only a center electrode has a discharge portion implemented by a noble-metal chip containing Ir as the main component and containing 20% by weight of Rh. The gasoline engine was operated at a speed of 5,000 rpm with the throttle opened completely and while using unleaded gasoline as fuel. After 20-hour operation, the appearance of the noble-metal chip was observed. As a result, as shown in FIG. 5, the noble-metal chip exhibited unusual wear, specifically, the noble-metal chip was arcuately eroded at a circumferential side surface which is not a discharge face (top surface of the discharge portion) facing the ground electrode. As is understood from FIG. 5, the unusual wear is unusual also in the form of wear and the cause for wear cannot be explained merely by spark discharge or oxidational volatilization. Although not shown, this unusual wear was similarly observed when the above-described operation (test) was performed using a noble-metal chip containing Ir as the main component and containing 10% by weight of Rh, 5% by weight of Rh or 1% by weight of Rh. As the Rh content becomes smaller, the degree of eroding from the circumferential side surface of the discharge portion became severer, in other words, unusual wear was more readily generated. As such, if a noble-metal chip increased in the Ir content and reduced in the expensive Rh content is used with an attempt to improve the spark wear resistance of the discharge portion and restrain the oxidational wear, unusual wear is newly incurred, failing in completely eliminating wear in the discharge portion.

The object of the present invention is to provide a spark plug having a discharge portion formed of a noble-metal chip, where the noble-metal chip forming the discharge part is increased in the Ir content and reduced in the expensive Rh content and which can be prevented from generation of unusual wear of eroding the circumferential side surface of the noble-metal chip and is equipped with a noble meal chip having excellent wear resistance.

DISCLOSURE OF THE INVENTION

In order to achieve the above-described object, the present invention provides a spark plug comprising a center electrode held at one end of a through hole of an insulator and a ground electrode facing the center electrode through a spark discharge gap, in which the discharge portion facing to a spark discharge gap of at least either the center electrode or the ground electrode is welded with a noble-metal chip, the spark plug being characterized in that the noble-metal chip contains 90% by weight or more of Ir, 0.5% by weight or more of Rh and from 0.5 to 8% by weight of Ni.

The present inventors examined the unusually worn discharge portion (noble-metal chip) shown in FIG. 5 and found that a deposit containing Ca and/or P is formed on the surface of the noble-metal chip. No unusual wear was observed on some noble-metal chips to which the deposit adheres. However, all of the noble-metal chips suffering unusual wear exhibit adhesion of the deposit induced by Ca and/or P. Therefore, such a deposit may be partially responsible for the above-mentioned unusual wear. As is apparent from FIG. 5, the unusual wear proceeds on a discharge portion (noble-metal chip) only from a certain direction, implying that the unusual wear is partially caused by the existence of a certain fluid flow within an ignition atmosphere where the discharge portion ignites. For example, conceivably, the above-mentioned fluid is a constant mixture flow (swirl flow) for uniformly diffusing fuel contained in the mixture. Also, the unusual wear may proceed from the above-mentioned two causes. In any case, the mechanism of such unusual wear is presumed to differ from that of wear arising as a result of melting or dispersion caused by spark discharge or that of wear arising as a result of simple oxidational volatilization on a noble-metal chip.

Focusing on the phenomenon that, as shown in FIG. 5, in the unusually worn noble-metal chip of Ir—Rh binary alloy, the periphery of the discharge face of the noble-metal chip is almost free from unusual wear, the present inventors analyzed the periphery of the discharge face for components and found that Ni is contained in the periphery of the discharge face. The present inventors also analyzed the unusually worn portion (circumferential side surface) for components and found that Ni is absent there. That is, Ni present in the periphery of the discharge face is not that which is contained from the beginning of fabrication of the noble-metal chip, but that which comes to be present in the course of use of the spark plug. Conceivably, repeated spark discharge causes Ni components to fly out from the ground electrode which is formed of Ni-based heat resistant alloy or a like metal, and the Ni components are subsequently injected into the periphery of the discharge face of the noble-metal chip. In any case, the present inventors acquired knowledge that, in an unusually worn noble-metal chip, a zone (the periphery of a discharge face) that is not susceptible to unusual wear contains Ni.

The present inventors found that in a noble-metal chip composed of an Ir—Rh binary alloy, as the Rh content becomes smaller, the circumferential side surface is more severely eroded due to unusual wear. The present inventors have made extensive investigations as above and found that when the discharge portion of a spark plug is composed of a noble-metal chip containing 90% by weight or more of Ir having a high melting point for improving the spark wear resistance and containing 0.5% by weight or more of Rh and from 0.5 to 8% by weight of Ni for restraining the wear due to oxidational volatilization of the Ir component, the oxidational wear can be restrained while improving the spark wear resistance and also the above-described unusual wear can be restrained. The present invention has been accomplished based on this finding.

The Ni content in the noble-metal chip is from 0.5 to 8% by weight. If the Ni content is less than 0.5% by weight, the effect of restraining unusual wear may not be satisfactorily exerted, whereas if the Ni content exceeds 8% by weight, the effect of improving the spark wear resistance by containing 90% by weight or more of Ir disadvantageously decreases due to the excessively large Ni content. Accordingly, the Ni content in the noble-metal chip is suitably from 0.5 to 8% by weight, more preferably from 1 to 4% by weight. The reason why the Ni content is more preferably from 1 to 4% by weight is as follows. With an Ni content of 1% by weight, the effect of restraining unusual wear can be satisfactorily brought out. On the other hand, when the Ni content exceeds 4% by weight, the effect of preventing unusual wear may be obtained but the Ni component in the material is sometimes oxidized due to heat added during process and cracks or the like are generated starting from the oxidized Ni and grow, as a result, at the production of a noble-metal chip by the process such as forging, rolling or punching, good processability may not be obtained.

The noble-metal chip is composed of an Ir-based alloy containing 90% by weight of Ir. Ir has a high melting point (2,454° C.) and therefore, when the Ir content is 90% by weight or more, good spark wear resistance can be obtained. However, since Ir component has a problem in that at a temperature exceeding 900° C., wear is liable to abruptly increase due to oxidational volatilization, the noble-metal chip of the present invention contains 0.5% by weight of Rh so as to restrain the oxidational volatilization of the Ir component. If the Rh content is less than 0.5% by weight, the effect of restraining the oxidational volatilization of Ir component is not sufficiently brought out and the noble-metal chip (discharge portion) is readily worn, failing in ensuring durability of the plug.

That is, in the present invention, the noble-metal chip is constituted to contain 90% by weight or more of Ir component having a high melting point and contain Rh which is more expensive than Ir and has a melting point lower than that of Ir, in a smaller amount within the range capable of exerting the effect of restraining the oxidational volatilization. As a result, the noble-metal chip (discharge portion) can be ensured with good wear resistance, the generation of unusual wear which readily occurs on decreasing the Rh content can be prevented by the addition of Ni and in turn, a spark plug having high performance can be fabricated at a low cost.

The noble-metal chip may contain an oxide (composite oxide) of an element(s) selected from the group consisting of Sr, Y, La, Ce, Pr, Nd, Sm, Eu, Gd, Tb, Dy, Ho, Er, Tm, Yb, Lu, Ti, Zr, and Hf, thereby more effectively restraining oxidational volatilization of Ir at high temperature. Preferably, at least either $La_2O_3$ or $Y_2O_3$ is contained as the above-mentioned oxide. Additionally, $ThO_2$, $ZrO_2$, or a like oxide can be favorably used. Preferably, the oxide(s) is contained in an amount of 0.5–3% by weight. An oxide content less than 0.5% by weight fails to sufficiently yield the expected effect of preventing oxidational volatilization of an added metal element component(s). An oxide content in excess of 3% by weight may only impair heat resistance of the noble-metal chip.

Figure 1:
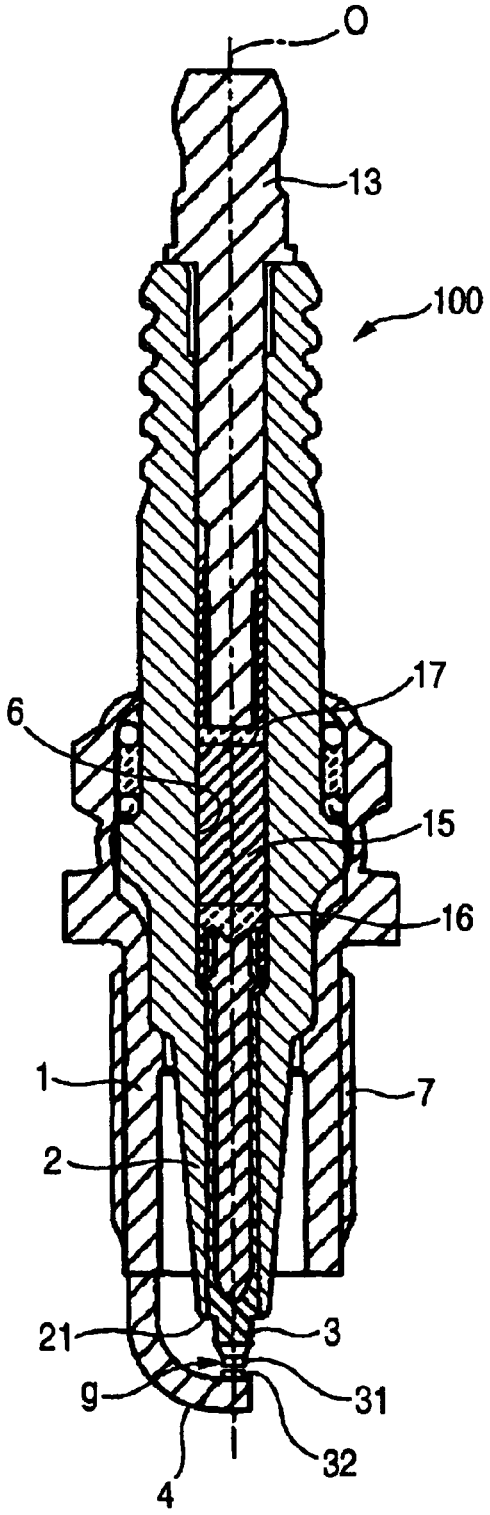
FIG. 1 is a front general sectional view showing an embodiment of a spark plug of the present invention.

Reference numerals are as follows:

100: spark plug
1: metal shell
2: insulator
3: center electrode
4: ground electrode
6: through hole
g: spark discharge gap
31, 32: discharge portion
31', 32': noble-metal chip
35: core
W: weld zone

BEST MODE FOR CARRYING OUT THE INVENTION

Figure 2:
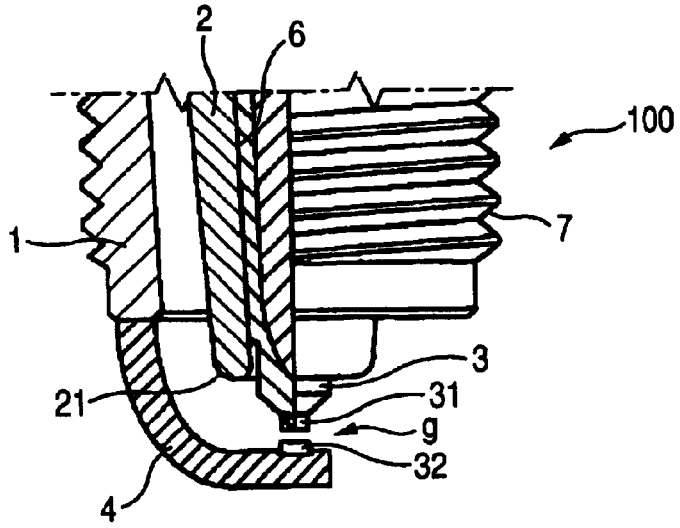
FIG. 2 is a partially sectional view of the spark plug of FIG. 1 and enlarged sectional view showing a main portion of the spark plug.
Figure 2:
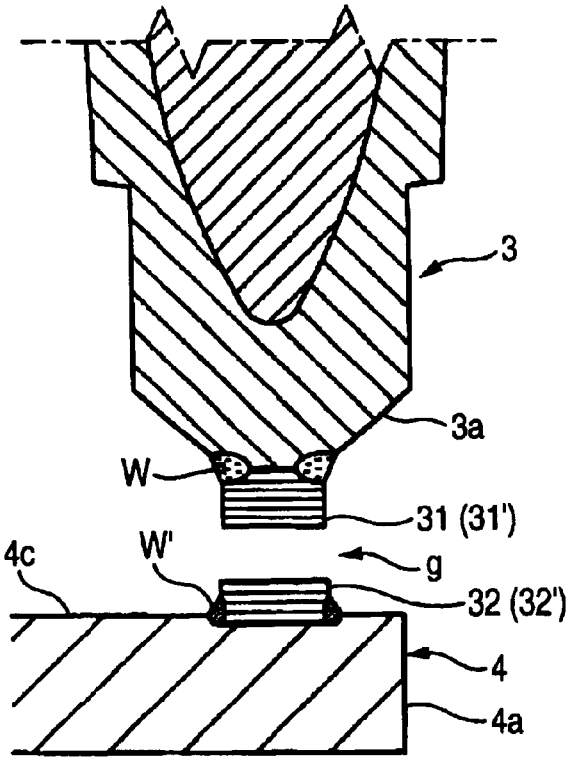

Embodiments of the present invention will next be described with reference to the section views. FIG. 1 is a vertical sectional view showing an example of a spark plug 100 of the present invention. FIG. 2(*a*) is an enlarged view showing a discharge portion and its periphery of the spark plug 100. The spark plug 100, which is an example of the present invention and contains a resistor, includes a cylindrical, metal shell 1; an insulator 2, which is fitted into the metal shell 1 such that a tip portion 21 projects from the metal shell 1; a center electrode 3, which is held at a leading end (one end) of a through hole 6 of the insulator 2 such that a discharge portion 31 formed on the tip thereof projects from the insulator 2; and a ground electrode 4, whose one end is joined to the metal shell 1 by welding or a like process and whose opposite end (4*a*) portion is bent such that its side surface (4*c*) faces the discharge portion 31 formed on the center electrode 3. A discharge portion 32 facing to the discharge portion 31 is formed on the ground electrode 4. A gap formed between the discharge portion 31 and the discharge portion 32 serves as a spark discharge gap g.

The insulator 2 is formed of, for example, an alumina or aluminum nitride ceramic sintered body and has a through hole 6 formed therein along the axial direction thereof for reception of the center electrode 3. The metal shell 1 is formed of metal, such as low-carbon steel, into a cylindrical shape to thereby form a housing of the spark plug 100. A threaded portion 7 is formed on the outer circumferential surface of the metal shell 1 for the purpose of mounting the spark plug 100 onto an unillustrated engine block. A metallic terminal member 13 is fixedly inserted into the through hole 6 from its one end, and the center electrode 3 is fixedly inserted into the through hole 6 from its opposite end. A resistor 15 is disposed within the through hole 6 between the metallic terminal member 13 and the center electrode 3. The resistor 15 is electrically connected, at opposite end portions thereof, to the center electrode 3 and the metallic terminal member 13 via electrically conductive glass seal layers 17 and 18, respectively. Notably, either one of the facing discharge portions 31 and 32 may be omitted. In this case, the spark discharge gap g is formed between the discharge portion 31 and the ground electrode 4 or between the discharge portion 32 and the center electrode 3.

The discharge portion 31 is formed, for example, in the following manner. As shown in FIG. 2(*b*), a disklike noble-metal chip 31' is brought in contact with a tip portion 3*a* of the center electrode 3, which is formed of, for example, an Ni base heat resistant alloy, such as INCONEL 600 (trademark of a product from INCO Corp., UK), or an Fe base heat resistant alloy. Then, a weld zone W is formed along the circumferential edge of interface between the components through laser welding, electron beam welding, electric resistance welding, or a like process, thereby joining the components. In the case where the discharge portion 32 is to be formed on the ground electrode 4, which is formed of, for example, an Ni base heat resistant alloy, such as INCONEL 600 and INCONEL 601, the discharge portion 32 is formed in the following manner. A noble-metal chip 32' is positioned on the ground electrode 4 at a position facing to the discharge portion 31 associated with the center electrode 3. Then, similarly, a weld zone W' is formed along the outer circumferential edge of interface between the components, thereby joining the components.

The discharge portion 31 or 32 is formed by use of the noble-metal chip 31' or 32' which contains 90% by weight or more of Ir, 0.5% by weight or more of Rh and 0.5 to 8% by weight of Ni. Preferably, the noble-metal chip contains 1 to 4% by weight of Ni.

The noble-metal chip 31' or 32' is formed, for example, in the following manner. Material noble-metal powders are mixed according to predetermined proportions. The resultant mixture is melted to form an alloy ingot. Specific examples of melting processes include arc melting, plasma beam melting, and high-frequency induction melting. The ingot may be formed as follows: the molten alloy is cast and then cooled rapidly by use of a water-cooled mold or a like device. The thus-obtained ingot features reduced segregation. Alternatively, the ingot may be formed as follows: a noble-metal powder mixture having a predetermined composition is compacted, followed by sintering.

Subsequently, the alloy ingot is formed into a wire-like or rod-like material by carrying out singly or in combination hot forging, hot rolling, and hot wire drawing. The wire-like or rod-like material is cut along the length direction into pieces, each having a predetermined length. For example, the alloy ingot is formed into a rod-like material by hot forging. The rod-like material undergoes hot rolling, which employs a grooved reduction roll, and hot swaging to thereby be further reduced in diameter. Finally, the thus-diameter-reduced material undergoes hot wire drawing to thereby become a wire having a diameter not greater than 0.8 mm. Subsequently, the wire is cut into pieces each having a predetermined thickness, thereby obtaining noble-metal chips 31' or 32'.

The noble-metal chip 31' or 32' may also be formed in the following manner. Alloy components are mixed and melted to obtain a molten alloy. The molten alloy is hot-rolled into a sheet. The sheet is subjected to hot blanking to blank out chips having a predetermined shape. Alternatively, a spherical noble-metal alloy is formed by a known atomization process. The thus-formed spherical noble-metal alloy may be used as a discharge portion as it is atomized or may be compressed, by use of a press or flat dies, into a flat or columnar noble-metal chip 31' or 32'.

Figure 3:
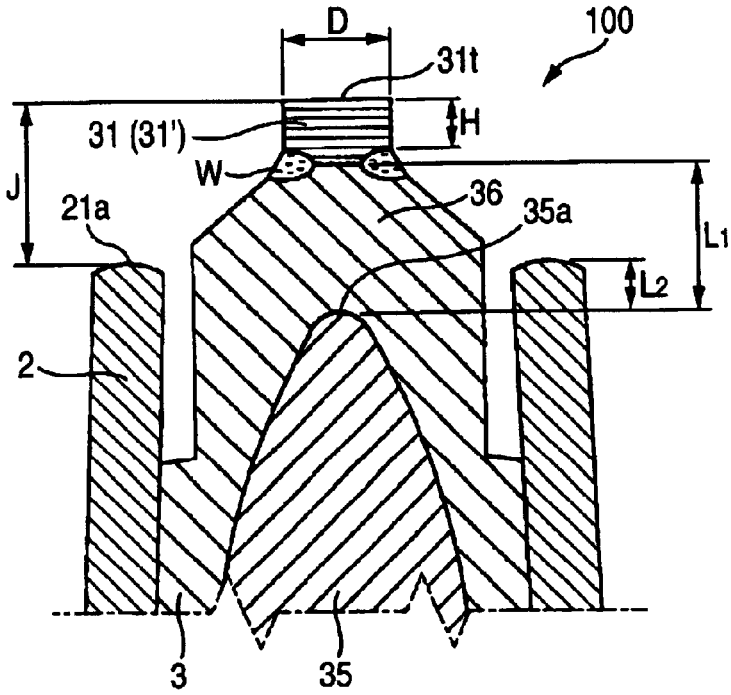
FIG. 3 is a view showing a discharge portion and its periphery in an enlarged condition and explaining definition of chip diameter D, discharge portion thickness H, etc.

As shown in FIG. 3, the spark plug 100 of the present examples has the discharge portion 31 slenderized. Specifically, a noble-metal chip serving as the discharge portion 31 has a chip diameter D of 0.3–0.8 mm and a discharge portion thickness H of 0.4–2 mm. The chip diameter D and the discharge portion thickness H are defined as shown in FIG. 3. That is, the chip diameter D is the outside diameter D of the discharge portion 31, and the discharge portion thickness H is the shortest distance in the axial direction between the periphery of a discharge face 31*t* of the discharge portion 31 and a corresponding end edge of the weld zone W where the center electrode 3 and the noble-metal chip 31' are welded. As in the case of the above-described discharge portion 31 associated with the center electrode 3, the chip diameter D and the discharge portion thickness H can be defined similarly for the discharge portion 32 associated with the ground electrode 4.

If the chip diameter D is less than 0.3 mm, sufficiently high durability cannot be maintained even against ordinary wear induced by spark discharge, oxidational volatilization or the like, whereas if the chip diameter D exceeds 0.8 mm, the effect of reducing the discharge voltage may not be obtained. Furthermore, if the thickness H of the discharge portion is less than 0.4 mm, the weld zone W is readily exposed to the discharge face due to repeated spark discharge and sufficiently high spark wear resistance may not be provided, whereas if the thickness H of the discharge portion exceeds 2.0 mm, the discharge portion tends to accumulate heat excessively and wearing proceeds in the discharge portion, resulting in unsatisfactory durability of the noble-metal chip.

The spark plug 100 of the present embodiment is configured such that the discharge portion 31 associated with the center electrode 3 is likely to increase in temperature. For example, as shown in FIG. 3, a core 35 is formed at a center portion of the center electrode 3, the core 35 being superior in thermal conductivity to an electrode base material 36 which forms a surface layer portion. The shortest distance L1 as measured along the axial direction between the discharge portion 31 and a tip 35*a* of the core 35 (hereinafter may be referred to as merely a core tip) located on the side toward the spark discharge gap g is 1–3 mm. Notably, the core 35 is adapted to release heat from the discharge portion 31 toward the center electrode 3 and formed of Cu, a Cu alloy, or a like metal. In the above-described configuration, when the above-defined distance L1 is not greater than 1 mm, the tip 35*a* of the core 35 is unavoidably located on the side toward the discharge portion 31 with respect to a tip 21*a* of the insulator. As a result, the core 35 expands due to excessive accumulation of heat and may break the insulator 2 from inside. Also, the electrode base material 36, which forms the surface layer portion, may be worn with a resultant exposure of the core 35. When L1 exceeds 3 mm, the temperature of the discharge portion 31 becomes too high; as a result, the discharge portion 31 fails to resist wear effected by a repetition of spark discharge. Preferably, L1 is 1.5–2.5 mm.

Figure 4:
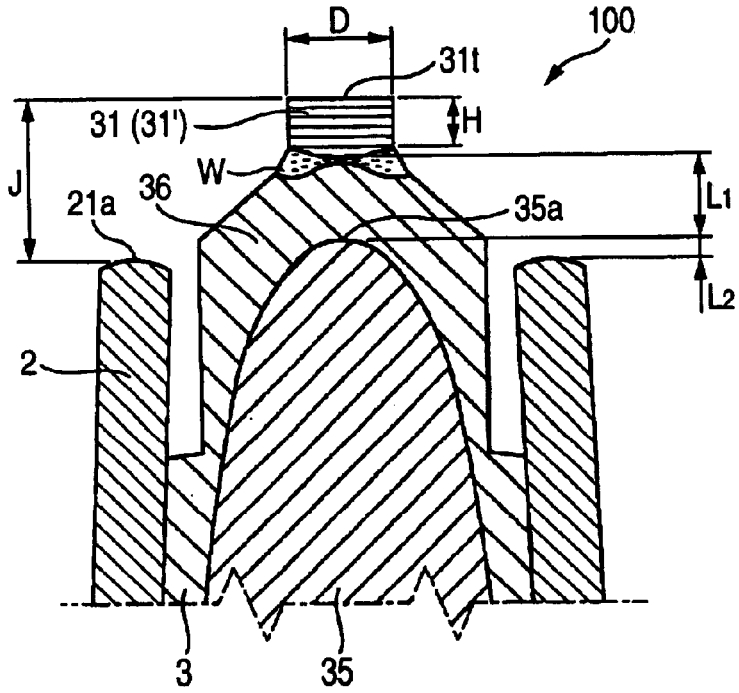
FIG. 4 is a view explaining definition of chip diameter D, discharge portion thickness H, etc., subsequent to FIG. 3.
Figure 5:
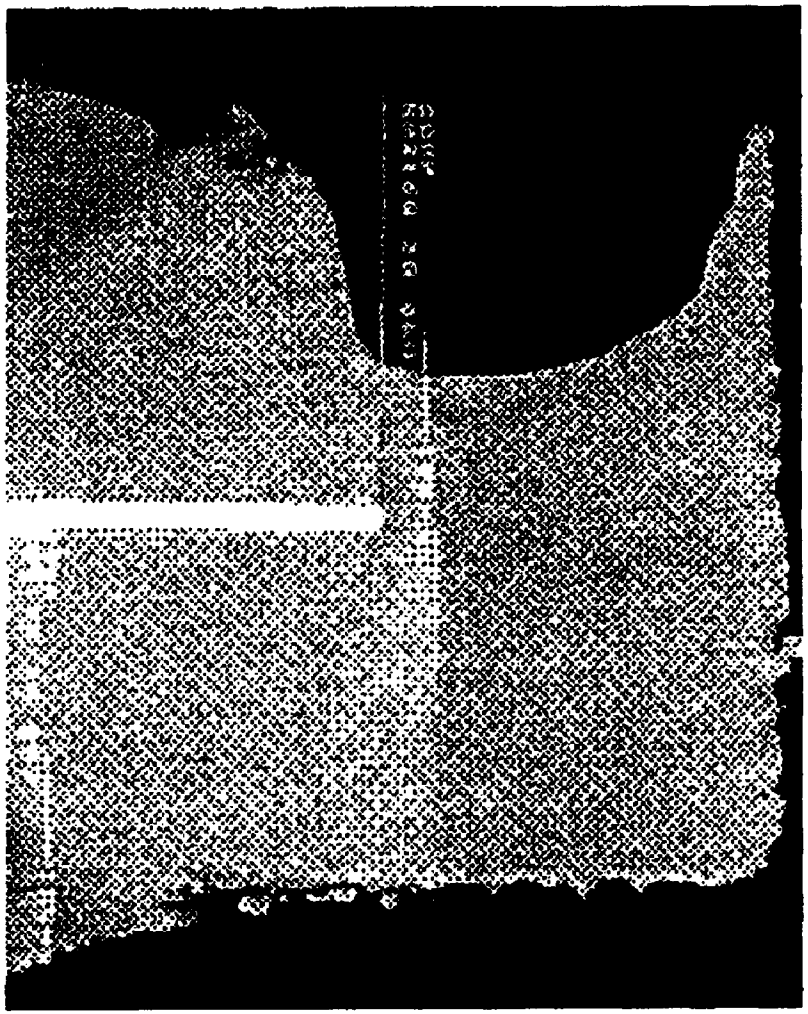
FIG. 5 is an observation view showing state of unusual wear of a discharge portion at center electrode-side.

As shown in the section view of FIG. 4, the weld zone W for welding the noble-metal chip 31' and the center electrode 3 may be formed continuously along the diametral direction of the noble-metal chip 31'. In this case, the shortest distance L1 between the discharge portion 31 and the tip 35*a* of the core 35 is defined similarly as in the case of FIG. 3.

As shown in FIG. 3, when the letter J represents the shortest distance as measured along the axial direction between the discharge face 31*t* and the tip 21*a* of the insulator 2 (hereinafter may be referred to as merely an insulator tip) located on the side toward the spark discharge gap g, the distance J is preferably not less than 1.5 mm. Employment of a J value not less than 1.5 mm causes a reduction in discharge voltage. When the J value is less than 1.5 mm, the electric field becomes unlikely to be concentrated on the discharge face 31*t*, and thus discharge voltage increases; therefore, the effect of slenderization of the discharge portion 31 is lost.

As shown in FIGS. 3 and 4, when L2 represents the shortest distance as measured along the axial direction between the tip 21*a* of the insulator 2 and the tip 35*a* of the core 35, L2 is not greater than 1 mm in the case where the tip 35*a* of the core 35 is located on the side toward the discharge face 31*t* with respect to the tip 21*a* of the insulator 2 (in the case of FIG. 4); and L2 is not greater than 1.5 mm in the case where the tip 21*a* of the insulator 2 is located on the side toward the discharge face 31*t* with respect to the tip 35*a* of the core 35 (in the case of FIG. 3). By specifying the range of the L2 value as described above, the previously defined L1 value can be readily set so as to fall within the preferred range.

The above-described spark plug 100 is mounted on an engine block via the threaded portion 7 thereof and used as an ignition source for igniting a mixture to be fed into a combustion chamber. In the course of use, discharge voltage is applied between the discharge portions 31 and 32 to thereby generate sparks in the spark discharge gap g (reference numerals correspond to those in FIG. 1). When the spark plug 100 of the present invention is used in an ignition atmosphere in which Ca and P are present, the effect of the discharge portions 31 and 32 in the noble-metal chip having the constitution mentioned above is effectively yielded. Since Ca and P present in the ignition atmosphere are contained in engine oil for use with an internal combustion engine, the spark plug 100 of the present invention can be favorably used in an internal combustion engine which uses such engine oil.

The present invention is described above in view of embodiments of the present invention, however, the present invention is not limited thereto. Needless to say, appropriate changes can be made therein without departing from the gist of the present invention.

For example, in the above-described example, a noble-metal chip 31' is superposed on the end face of a tip portion 3*a* of the center electrode 3 and a weld zone W is formed along the circumferential edge of interface between those components through laser welding or the like. However, in order to facilitate the positioning and fixing of the noble-metal chip 31' to the tip portion 3*a* of the center electrode 3, it may be also possible to form a groove for positioning on the end face of the tip portion 3*a* to correspond to the outside shape of chip, fit the noble-metal chip 31' into the groove for positioning and thereafter, form the weld zone W. In this case, when the weld zone W is formed, for example, by irradiating a laser ray on the crossed edge between the opening circumferential edge of groove for positioning and the outer circumferential surface of chip, the joining by welding can be performed without fail.

Furthermore, although the spark plug 100 in the above-described example is a so-called one electrode type where only one ground electrode 4 is formed, the present invention can also be applied to a multi-electrode type having a plurality of ground electrodes.

EXAMPLES

In order to study the effect of the present invention, the following experiments were conducted.

Experiment Example 1

Noble-metal chips for use as a discharge portion of a spark plug were manufactured in the following manner. In order to prepare noble-metal chips each having a different composition as in Table 1, predetermined element components were mixed according to various compositions, thereby obtaining various material powders. Next, the material powders were each compacted into a columnar form having a diameter of 20 mm and a length of 130 mm. The thus-formed green compacts were placed within an arc melting furnace and arc melted, thereby obtaining alloy ingots of various compositions. The alloy ingots were each subjected to hot forging, hot rolling, hot swaging, and hot wire drawing, at about 1500° C., thereby obtaining alloy wires each having a diameter of 0.6 mm. The wires were cut along the longitudinal direction into pieces, thereby obtaining disklike noble-metal chips of various compositions each having a diameter (chip diameter) of 0.6 mm and a thickness of 0.8 mm.

The processability of the noble-metal chip was evaluated as follows. Various noble-metal chips having different compositions shown in Table 1 were manufactured by a process and a chip which could be manufactured without causing generation of cracks during the process was rated ○ and a chip which could be manufactured as a noble-metal chip, though the presence of cracks was confirmed by a magnifier at a magnification of 40 in the inspection after the process was rated Δ. The evaluation results of processability are shown in Table 1.

Those various noble-metal chips obtained above each was placed on the tip surface of a center electrode base material made of INCONEL 600 and in this state, welded by laser welding, thereby producing spark plugs shown in FIG. 1 or 2. The laser welding was performed by appropriately adjusting the laser welding conditions depending on the noble-metal chip having each composition such that the shortest distance (thickness H of discharge portion) from the periphery of the discharge face to the corresponding end edge of the weld zone where the center electrode and the noble-metal chip were welded, became 0.5 mm after the laser welding. In this experiment example, the discharge portion associated with the ground electrode of each spark plug was formed of a noble-metal chip having components of Pt-20% by weight Ni and having a chip diameter of 0.9 mm and a thickness of 0.6 mm.

TABLE 1

| | | Composition (% by weight) | Unusual Wear | Wear Resistance | Processability | Overall Evaluation |
|---|---|---|---|---|---|---|
| Example | 1 | Ir—0.5Rh—3Ni | ○ | Δ | ○ | ○ |
| | 2 | Ir—0.9Rh—1Ni | ○ | ○ | ○ | ◎ |
| | 3 | Ir—0.9Rh—2Ni | ○ | ○ | ○ | ◎ |
| | 4 | Ir—0.9Rh—3Ni | ○ | ○ | ○ | ◎ |
| | 5 | Ir—0.9Rh—7Ni | ○ | ○ | Δ | ○ |
| | 6 | Ir—2Rh—0.5Ni | Δ | ○ | ○ | ○ |
| | 7 | Ir—2Rh—2Ni | ○ | ○ | ○ | ◎ |
| | 8 | Ir—2Rh—4Ni | ○ | ○ | ○ | ◎ |
| | 9 | Ir—3Rh—1Ni | ○ | ○ | ○ | ◎ |
| | 10 | Ir—4Rh—5Ni | ○ | ○ | Δ | ○ |
| | 11 | Ir—6Rh—3Ni | ○ | ○ | ○ | ◎ |
| | 12 | Ir—8Rh—1Ni | ○ | ○ | ○ | ◎ |
| | 13 | Ir—9Rh—1Ni | ○ | ○ | ○ | ◎ |
| | 14 | Ir—0.9Rh—2Ni—1$Y_2O_3$ | ○ | ○ | ○ | ◎ |
| | 15 | Ir—0.9Rh—3Ni—0.5$La_2O_3$ | ○ | ○ | ○ | ◎ |
| Comparative Example | 16 | Ir—1Rh | X | — | ○ | X |
| | 17 | Ir—20Rh | X | — | ○ | X |
| | 18 | Ir—0.3Rh—3Ni | — | X | ○ | X |
| | 19 | Ir—2Rh—0.3Ni | X | — | ○ | X |
| | 20 | Ir—2Rh—9Ni | ○ | Δ | Δ | X |
| | 21 | Ir—10Rh—0.5Ni | Δ | Δ | ○ | X |
| | 22 | Ir—10Rh—5Ni | ○ | Δ | Δ | X |

The thus-obtained spark plugs were subjected to a durability test under the following conditions. Each spark plug was mounted on a gasoline engine (6 cylinders) of a piston displacement of 2,000 cc. The gasoline engine was run for up to 300 hours at an engine speed of 5,000 rpm with the throttle opened completely. Unleaded gasoline was used as fuel, and the tip temperature of the center electrode was 900° C. This durability test was performed by setting the spark discharge gap of each spark plug to 1.1 mm.

After the durability test, each spark plug was evaluated with an eye on the degree of unusual wear generated in the form of eroding one side part of the discharge portion (noble-metal chip). When unusual wear was not observed, this was rated ○; when unusual wear was observed but the durability test was completed, rated Δ; when unusual wear disabled continuation of the durability test, rated X; and when worn out independently of unusual wear, rated -. The evaluation results of unusual wear are shown in Table 1. Also, the amount of gap increase after the engine was run for durability test time was measured and as for the evaluation results (evaluation results of wear resistance), when the increment of spark discharge gap was less than 0.15 mm, this was rated ○; when 0.15 to 0.3 mm, rated Δ; and when exceeded 0.3 mm, rated X. When unusual were disabled the durability test, the amount of gap increase was not measured and this was rated -. The overall evaluation in Table 1 was performed by taking account of all evaluation results on unusual wear, wear resistance and processability, that is, rated ◎ when all evaluation results were ○; rated ○ when two evaluation results were ○ and one evaluation result was Δ; and rated X for others.

It is seen from Table 1 that in the noble-metal chips containing 90% by weight of Ir, 0.5% by weight of Rh and 0.5 to 8% by weight of Ni and the spark plugs using these noble-metal chips (Example Nos. 1 to 15), generation of unusual wear is restrained and at the same time, wear resistance and processability are excellent. Particularly, in Example Nos. 1 to 4, 7 to 9 and 11 to 15 where the Ni content is in the range from 1 to 4% by weight, generation of unusual wear is more effectively restrained and the noble-metal chip exhibits good processability.

On the other hand, in Comparative Example Nos. 16 and 17 where Ni is not contained and in Comparative Example No. 19 where the Ni content is less than 0.5% by weight, generation of unusual wear cannot be restrained. In Comparative Example Nos. 20 to 22 where Ni is contained but the Ir content is less than 90% by weight, good wear resistance cannot be obtained due to decrease of the spark wear resistance and the evaluation result is not good in either unusual wear or processability. In Comparative Example No. 18 where the Rh content is less than 0.5% by weight, the effect of restraining the oxidational volatilization of Ir cannot be satisfactorily exerted and the wear resistance is decreased.

Experiment Example 2

Next, spark plugs were fabricated such that the composition of a noble-metal chip serving as a discharge portion is that of Example No. 3 or Comparative Example No. 16 in Table 1, and the lengths L1 and L2 defined previously in the description of the embodiments (FIGS. 3 and 4) are varied as shown in Table 3. The spark plugs have a chip diameter D of 0.3–0.8 mm and a discharge portion thickness H of 0.4–2 mm and other dimensional features similar to those of Experiment Example 1. The spark plugs were subjected to a durability test similar to that conducted in Experiment Example 1 and evaluated for the degree of unusual wear as observed on a discharge portion after the durability test. The results are shown in Table 2. In the present Experiment Example, L2 values whose sign is minus (−) represent the shortest distance between the tip of a core and the tip of an insulator in the case where the tip of the core is located on the side toward a discharge portion with respect to the tip of the insulator as shown in FIG. 4, and as shown in FIG. 3 other L2 values represent the shortest distance between the tip of a core and the tip of an insulator in the case where the tip of the insulator is located on the side toward a discharge portion with respect to the tip of the core.

TABLE 2

| | Composition (% by weight) | L1 (mm) | L2 (mm) | Evaluation |
|---|---|---|---|---|
| 1 | * | 1.0 | 0.3 | X |
| 2 | Ir—1Rh | 1.0 | −0.2 | X |
| 3 | | 1.5 | 0.8 | X |
| 4 | | 1.5 | 0.3 | X |
| 5 | | 2.0 | 1.3 | X |
| 6 | | 2.0 | 0.8 | X |
| 7 | | 3.0 | 2.3 | X |
| 8 | | 3.0 | 1.8 | X |
| 9 | | 0.8 | 0.1 | Δ |
| 10 | Ir—0.9Rh—2Ni | 1.0 | 0.3 | ○ |
| 11 | | 1.0 | −0.2 | ○ |
| 12 | | 1.5 | 0.8 | ○ |
| 13 | | 1.5 | 0.3 | ○ |
| 14 | | 2.0 | 1.3 | ○ |
| 15 | | 2.0 | 0.8 | ○ |
| 16 | | 3.0 | 2.3 | ○ |
| 17 | | 3.0 | 1.8 | ○ |
| 18 | | 0.8 | 0.1 | ○ |

"*" means being out of the range of the present invention

As shown in Table 2, Comparative Examples do not contain Ni, and Comparative Example Nos. 1–8 having an L1 value of 1 to 3 mm and an L2 value of −1 to 1.5 mm exhibited marked unusual wear of a discharge portion since the discharge portion tends to assume high temperature. The spark plug whose L1 and L2 values fall outside the above corresponding ranges (Comparative Example No. 9) exhibited occurrence of unusual wear; however, the degree of wear was less than those of the spark plugs whose L1 and L2 values fall within the above corresponding ranges, conceivably because a spark portion is well heat-released and thus becomes unlikely to assume high temperature. In the case of Example Nos. 10–18, the effect of reducing unusual wear is sufficiently yielded through addition of Ni as observed with the spark plug whose L1 and L2 values fall outside the above corresponding ranges and even with the spark plugs whose L1 and L2 values fall within the above corresponding ranges and whose discharge portions thus tend to assume high temperature.

As apparent from the results in these two experiments, when a noble-metal chip containing 90% by weight or more of Ir component having a high melting point, containing Rh which is more expensive than Ir and has a melting point lower than that of Ir, in a smaller amount within the range capable of exerting the effect of restraining the oxidational volatilization, and containing Ni component in the above-described range is used for the discharge portion, the noble-metal chip (discharge portion) can be ensured with good wear resistance, the generation of unusual wear which readily occurs on decreasing the Rh content can be prevented and in turn, a spark plug having high performance can be fabricated at a low cost.

While the present invention has been described in detail and with reference to specific embodiments thereof, it will be apparent to one skilled in the art that various changes and modifications can be made therein without departing from the spirit and scope of the present invention.

This application is based on Japanese Patent Application (Patent Application No. 2001-091585) filed on Mar. 28, 2001, the contents of which are incorporated herein by way of reference.

INDUSTRIAL APPLICABILITY

The present invention is a spark plug having a discharge portion formed of a noble-metal chip increased in the Ir content while reducing the content of expensive Rh, which can be restrained from generation of unusual wear in the form of eroding the circumferential side surface of the noble-metal chip and exhibits excellent wear resistance.

What is claimed is:

1. A spark plug comprising:

a center electrode held at one end of a through hole of an insulator; and a ground electrode facing the center electrode through a spark discharge gap, wherein a discharge portion of at least one of the center electrode and the ground electrode is welded with a noble-metal chip, the discharge portion facing to the spark discharge gap, and the noble-metal chip comprises 90% by weight or more of Ir, 0.5% by weight or more of Rh and 0.5 to 8% by weight of Ni.

2. The spark plug according to claim 1, wherein the noble-metal chip comprises 1 to 4% by weight of Ni.

3. The spark plug according to claim 1 or 2, wherein the noble-metal chip comprises at least one of $La_2O_3$ and $Y_2O_3$.

4. The spark plug according to claim 3, wherein the noble-metal chip comprises 0.5 to 3% by weight of the at least one of $La_2O_3$ and $Y_2O_3$.

* * * * *